US008143804B2

(12) United States Patent
Ger et al.

(10) Patent No.: US 8,143,804 B2
(45) Date of Patent: Mar. 27, 2012

(54) LIGHT SOURCE DRIVING DEVICE

(75) Inventors: Chih-Chan Ger, Jhongli (TW); Chia-Kun Chen, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 280 days.

(21) Appl. No.: 12/612,011

(22) Filed: Nov. 4, 2009

(65) Prior Publication Data

US 2010/0213862 A1 Aug. 26, 2010

(30) Foreign Application Priority Data

Feb. 20, 2009 (CN) ..... 2009 2 0129944 U

(51) Int. Cl.
*H05B 37/02* (2006.01)

(52) U.S. Cl. ..... 315/291; 315/158; 315/224; 315/247; 315/276

(58) Field of Classification Search ..... 315/149, 315/152, 158, 159, 209 R, 210, 219, 221, 315/224, 247, 250, 276, 291, 307
See application file for complete search history.

(56) References Cited

U.S. PATENT DOCUMENTS 7,667,411 B2 * 2/2010 Kim et al. ..... 315/282
7,940,535 B2 * 5/2011 Itoh et al. ..... 363/21.12
7,999,493 B2 * 8/2011 Hsu ..... 315/307

* cited by examiner

*Primary Examiner* — Thuy Vinh Tran
(74) *Attorney, Agent, or Firm* — Altis Law Group, Inc.

(57) ABSTRACT

A light source driving device includes a power factor correction (PFC) circuit, a power stage circuit, a power conversion circuit, a balancing circuit, an inverter control signal processor, an inverter controller and an isolation component. Alternating current (AC) signals are converted into electrical signals to drive lamps via the PFC circuit, the power stage circuit, the power conversion circuit and the current balancing circuit. The power conversion circuit including a transformer divides the driving device into a primary side and a secondary side. The inverter control signal processor receives a first control signal output from a secondary side and generates a second control signal. The inverter controller is disposed on the secondary side to drive the power stage circuit.
The isolation component transmits the second control signal to the inverter controller and isolates the inverter control signal processor from the inverter controller.

14 Claims, 6 Drawing Sheets

LIGHT SOURCE DRIVING DEVICE

BACKGROUND

1. Technical Field

The present disclosure relates to light source driving devices, and particularly to a light source driving device integrated with an alternating current (AC)/direct current (DC) converter.

2. Description of Related Art

Conventionally, discharge lamps, such as cold cathode fluorescent lamps (CCFLs) and external electrode fluorescent lamps (EEFLs) have been used as backlights for liquid crystal displays (LCDs). In LCD modules, the discharge lamps of the backlights are driven by AC signals provided by inverter circuits.

FIG. 6 shows a commonly used light source driving device for a light source module 20. An AC power source 10 provides AC signals to a power factor correction (PFC) circuit 12 via an electro magnetic interference (EMI) filter 11. The PFC circuit 12 is controlled by a PFC controller 19, and converts the AC signals into DC signals. A power stage circuit 13 converts the DC signals into square-wave signals. A primary side of a power conversion circuit 14 is connected to the power stage circuit 13, to step the square-wave signals. A balancing circuit 15 is connected to a secondary side of the power conversion circuit 14, to balance current flowing through the light source module 20. An inverter controller 16 outputs a control signal based on a dimming signal or a switch signal via a pulse-width modulation (PWM) isolation transformer 17 and a driving circuit 14 to control output of the power stage circuit 13. The PFC controller 19 controls output of the PFC circuit 12.

In common use, the inverter controller 16 is disposed on the secondary side of the transformer 14, requiring a separate driving circuit 18 to drive the power stage circuit 13, and also the PWM isolation transformer 17 to isolate the inverter controller 16 from the driving circuit 18 and the power stage circuit 13 and control the driving circuit 18 and the power stage circuit 13. Thus, the commonly used light source driving device is not only overly complex but also larger, due to the isolation transformer.

DETAILED DESCRIPTION

Figure 1:
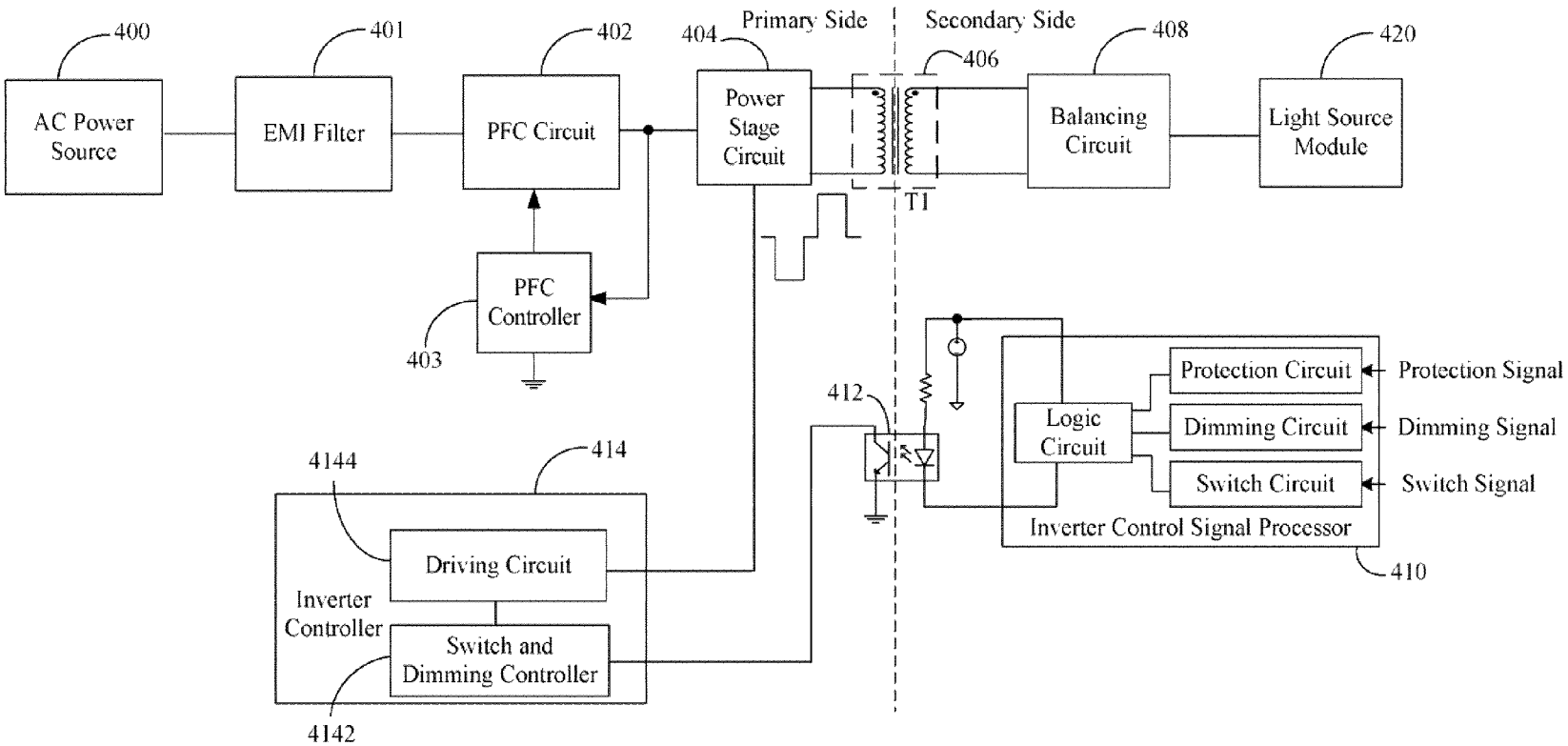
FIG. 1 is a block diagram of a first embodiment of a light source driving device in accordance with the present disclosure.

FIG. 1 is a block diagram of a first embodiment of a light source driving device for a light source module 420 in accordance with the present disclosure. The light source driving device comprises an alternating current (AC) power source

400, an electro-magnetic interference (EMI) filter 401, a power factor correction (PFC) circuit 402, a PFC controller 403, a power stage circuit 404, a power conversion circuit 406, a balancing circuit 408, an inverter control signal processor 410, an isolation component 412 and an inverter control 414. In one embodiment, the light source module 420 comprises a plurality of light sources, such as discharge lamps. The isolation component 412 may be a photo-coupler, in one example.

The AC power source 400 provides alternating current (AC) signals. The AC signals are filtered via the EMI filter 401 and output to the PFC circuit 402. The EMI filter 401 is connected between the AC power source 400 and the PFC circuit 402 to filter EMI in the AC signals. PFC circuit 402 is a boost circuit, which converts the AC signals to direct current (DC) signals and boosts the DC signal. Voltage of the boosted DC signals may be approximately 400V, in one example.

In one embodiment, the PFC controller 403 receives a DC feedback signal from output of the PFC circuit 402, and then controls the output of the PFC circuit 402 according to the DC feedback signal.

The power stage circuit 404 is connected to the output of the PFC circuit 402, to convert the DC signals output from the PFC circuit 402 to square-wave signals. In one embodiment, the power stage circuit 404 can be a full-bridge circuit or a half-bridge circuit.

The power conversion circuit 406 converts the square-wave signals to electrical signals to drive the light source module 420. In one embodiment, the electrical signals may be sine-wave signals. Alternatively, the electrical signal can include square-wave signals. The power conversion circuit 406 comprises a transformer T1 having a primary winding and a secondary winding. The primary winding and the secondary winding of the transformer T1 divides the light source driving device into a primary side and a secondary side, and connects to the power stage circuit 404 and the balancing circuit 408 respectively. In other alternative embodiments, the transformer T1 may comprise a plurality of secondary winding. It is well known that the transformer T1 isolates the AC power source 400 from the light source module 420 and the balancing circuit 408 according to a safety standard, in order to protect the light source module 420 and the balancing circuit 408.

The balancing circuit 408 balances current flowing through the plurality of light sources in the light source module 408. Because some difference exists between each light source, capacitors, inductors, transformers or a combination thereof can be used to balance the current.

The inverter control signal processor 410 is disposed on the secondary side of the light source driving device, to receive a first control signal. The first control signal comprises a dimming signal, a switch signal and a protection signal. The inverter control signal processor 410 processes the first control signal and outputs a second control signal to the inverter controller 414. In one embodiment, the first and the second control signal are low-frequency signals.

Figure 2:
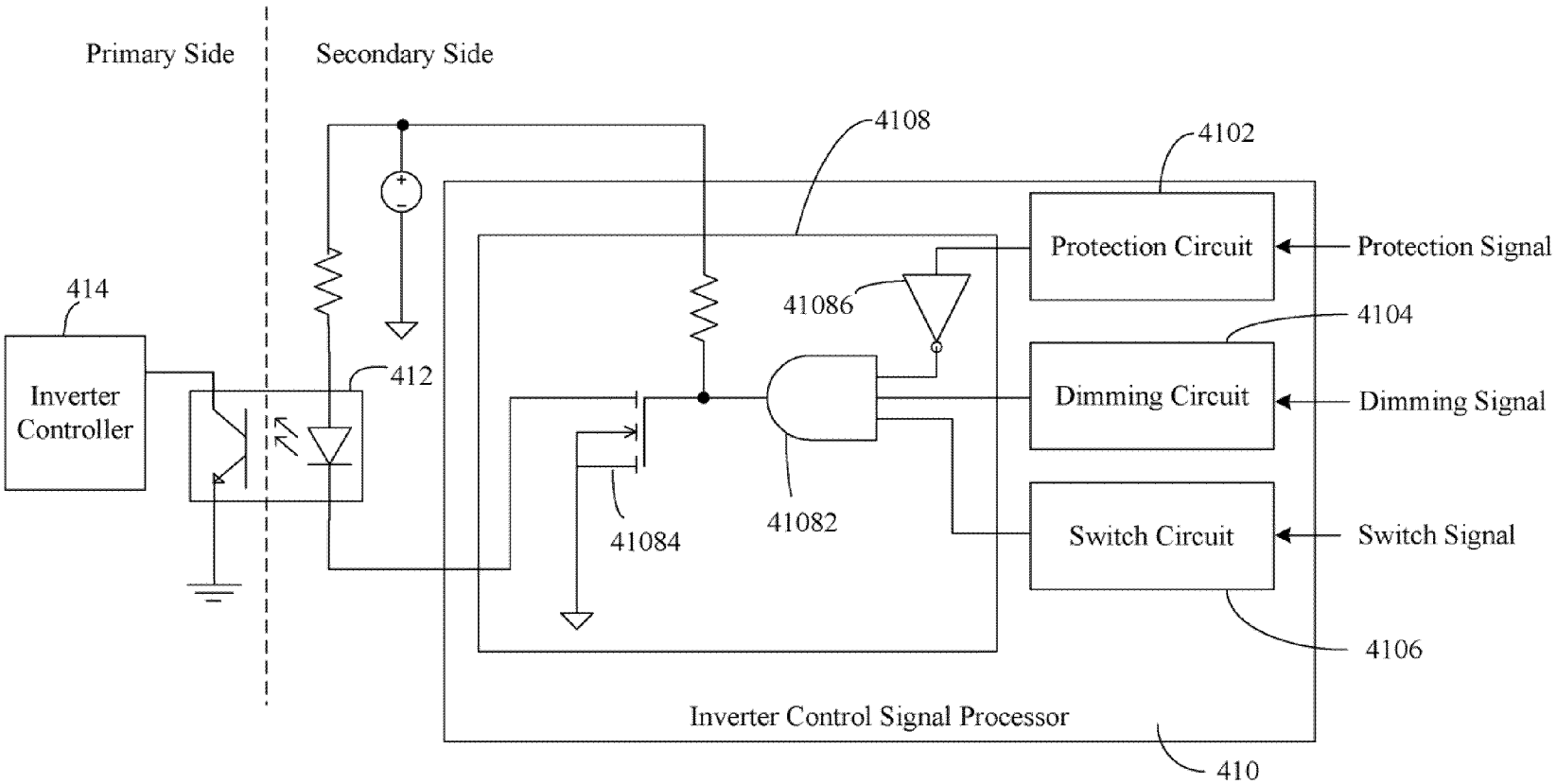
FIG. 2 is a block diagram of one embodiment of an inverter control signal processor of FIG. 1.

Also referring to FIG. 2, inverter control signal processor 410 comprises a protection circuit 4102 to receive the protection signal, a dimming circuit 4104 to receive the dimming signal, a switch circuit 4106 to receive the switch signal and a logic circuit 4108. The protection circuit 4102, the dimming circuit 4104 and the switch circuit 4106 process the protection signal, the dimming signal and the switch signal and output a processed protection signal, a processed dimming signal and a processed switch signal respectively. The logic circuit 4108 comprises an inverter 41086, a AND gate 41082 and a switch 41084. An input of the inverter 41086 is connected to the protection circuit 4102, and inputs of the AND gate 41082 are connected to the output of the inverter 41086, the dimming circuit 4104 and the switch circuit 4106 respectively. An output of the AND gate 41082 is connected to the switch 41084. When the dimming circuit 4104 and the switch circuit 4106 output the processed dimming signal and the processed switch signal and the protection circuit 4102 does not output the processed protection signal, the AND gate 41082 triggers the switch 41084 to output the second control signal.

Alternatively, the first control signal can comprise only the dimming signal and the switch signal, wherein the inverter control signal processor 410 comprises the dimming circuit 4104, the switch circuit 4106 and the logic circuit 4108 correspondingly, which omits the protection circuit 4102. Inputs of the AND gate 41082 of the logic circuit 4108 are connected to the dimming circuit 4104 and the switch circuit 4108 respectively. When the dimming circuit 4104 and the switch circuit 4108 output the processed dimming signal and the processed switch signal, the AND gate 41082 triggers the switch 41084 to output the second control signal.

The photo-coupler 412 is connected between the inverter controller 414 and the inverter control signal processor 410, to provide isolation therebetween.

In detail, the photo-coupler 412 is connected to the switch 41084. When the switch 41084 is triggered, the photo-coupler 412 couples the second control signal to the inverter controller 414.

In other alternative embodiments, the photo-coupler 412 can be replaced by other isolation components, such as an isolation transformer.

Returning to FIG. 1, the inverter controller 414 is connected to the power stage circuit 404 and the photo-coupler 412, which outputs a third control signal to drive the power stage circuit 404 according to the second control signal output from the photo-coupler 412. In one embodiment, the third control signal may be a high-frequency signal.

The inverter controller 414 comprises a switch and dimming controller 4142 and a driving circuit 4144. In one embodiment, the switch and dimming controller 4142 is connected to the photo-coupler 412, to receive the second control signal and turn the inverter controller 414 on and off. The driving circuit 4144 is connected to the power stage circuit 404, to output the third control signal to drive the power stage circuit 404.

Figure 3:
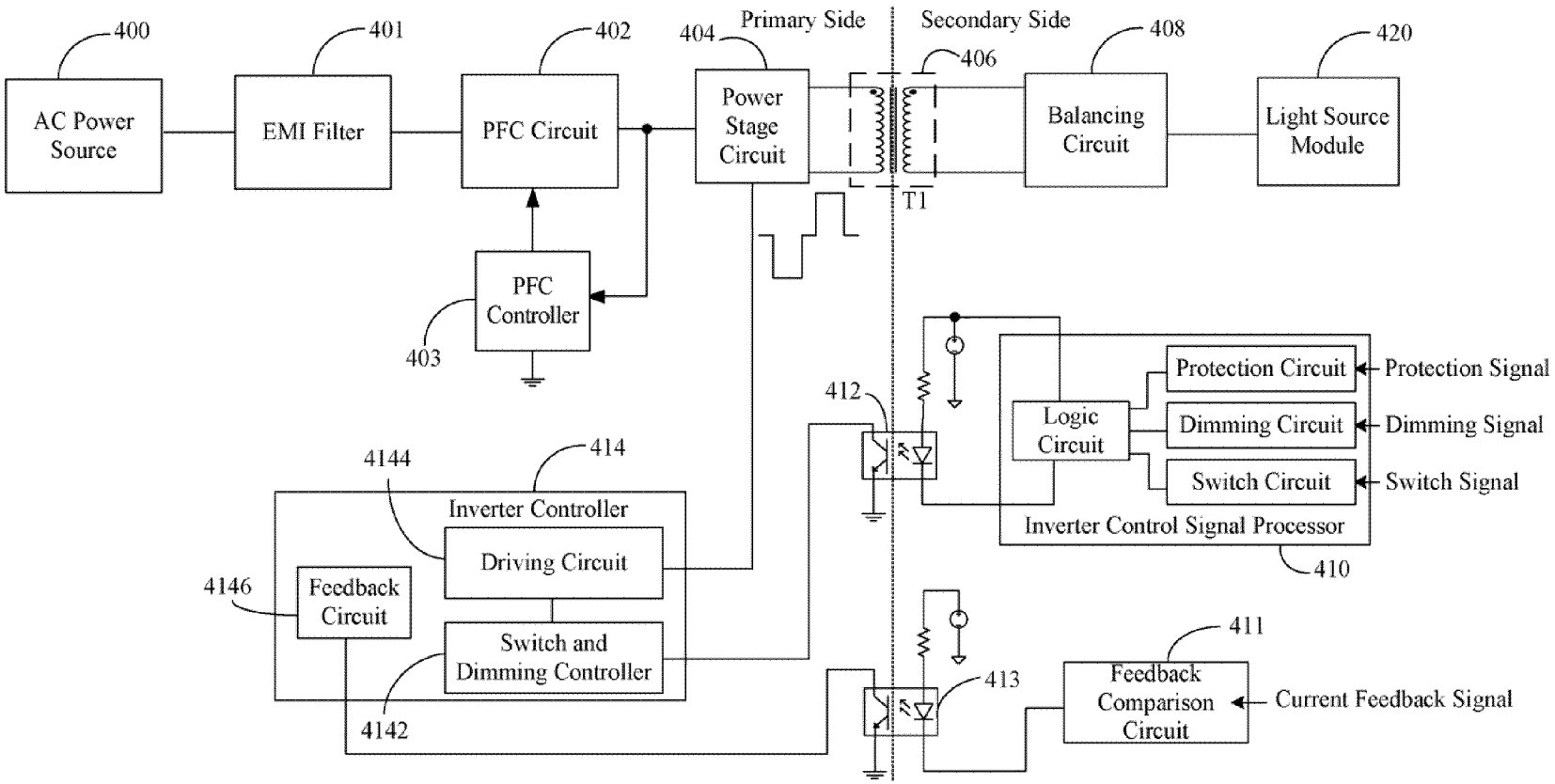
FIG. 3 is a block diagram of a second embodiment of a light source driving device in accordance with the present disclosure.

FIG. 3 is a block diagram of the light source driving device of a second embodiment, differing from that of FIG. 1 in the presence of a feedback comparison circuit 411 and another photo-coupler 413, with the inverter controller 414 comprising a feedback circuit 4146.

The feedback comparison circuit 411 is disposed on the secondary side of the light source driving device, to receive a current feedback signal.

The photo-coupler 413 is connected between the feedback comparison circuit 411 and the feedback circuit 4146 of the inverter controller 414, to provide isolation therebetween.

Figure 4:
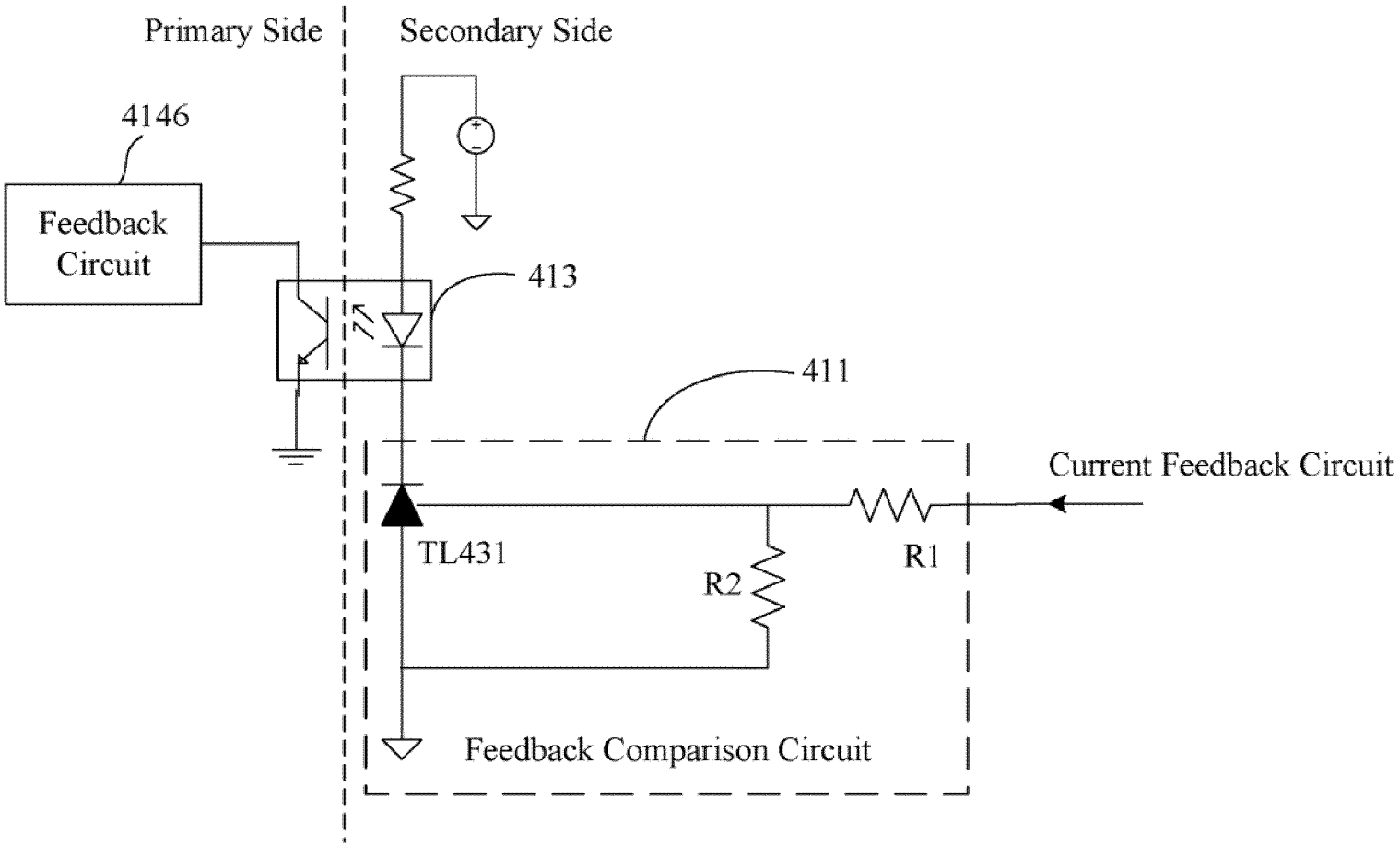
FIG. 4 is a block diagram of one embodiment of a feedback comparison circuit of FIG. 3.

FIG. 4 is a circuit diagram of the feedback comparison circuit 411, which comprises a three-terminal shunt regulator TL431 and resistors R1, R2. The three-terminal shunt regulator TL431 comprises an input pin, a ground pin and an output pin. The resistor R2 is connected between the input pin and the ground pin of the three-terminal shunt regulator TL431. One end of the resistor R1 is connected to the input pin of the three-terminal shunt regulator TL431, and the other end thereof receives the current feedback signal. The photo-coupler 413 is connected between the three-terminal shunt regulator TL431 and the feedback circuit 4146. The current feedback signal is transmitted to the three-terminal shunt regulator TL431 via the resistor R1, and then the three-terminal shunt regulator TL431 controls the photo-coupler 413 to couple the current feedback signal to the feedback circuit 4146. Consequently, the driving circuit 4144 can drive the power stage circuit 404.

Figure 5:
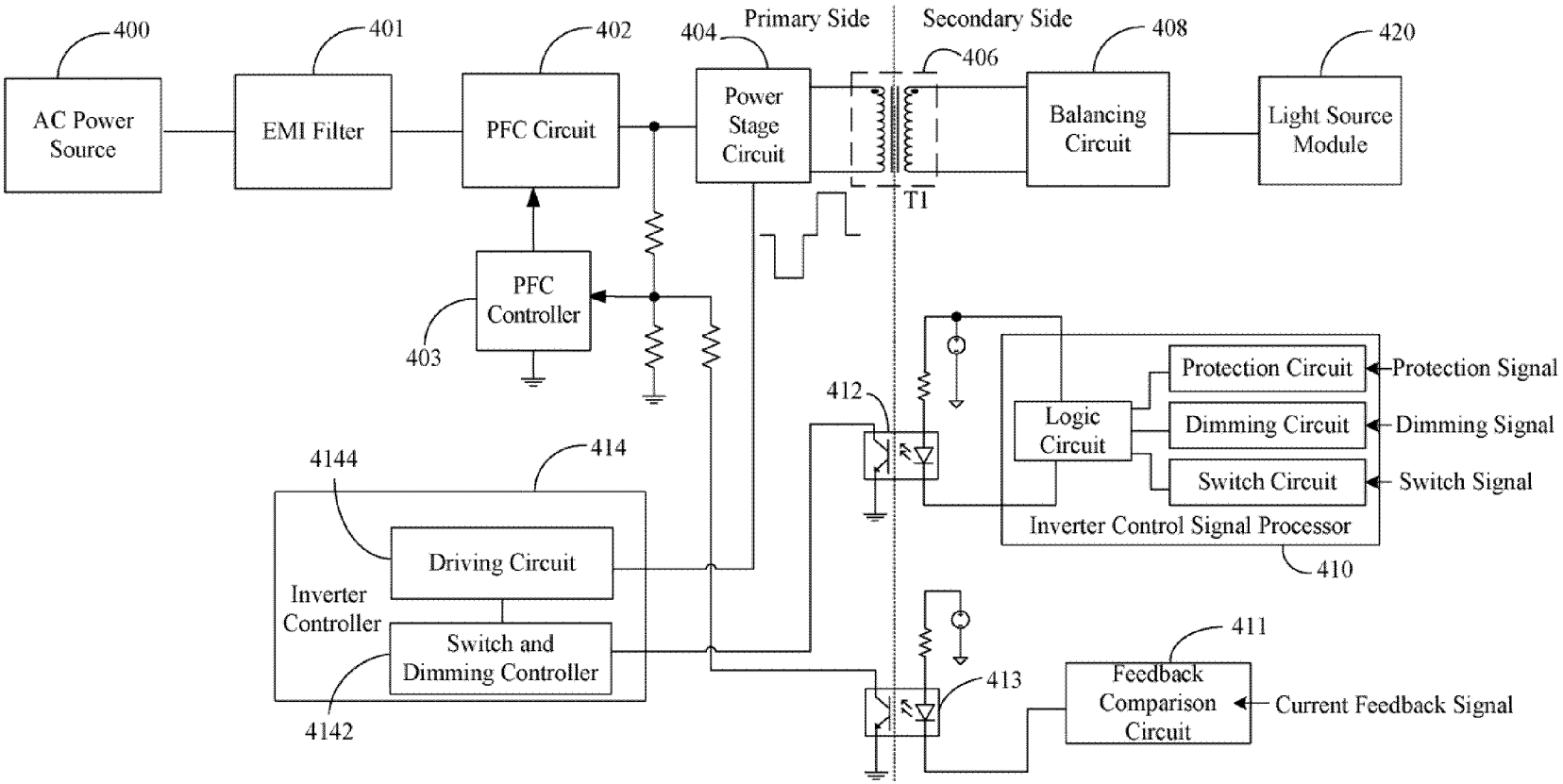
FIG. 5 is a block diagram of a third embodiment of a light source driving device in accordance with the present disclosure.
Figure 6:
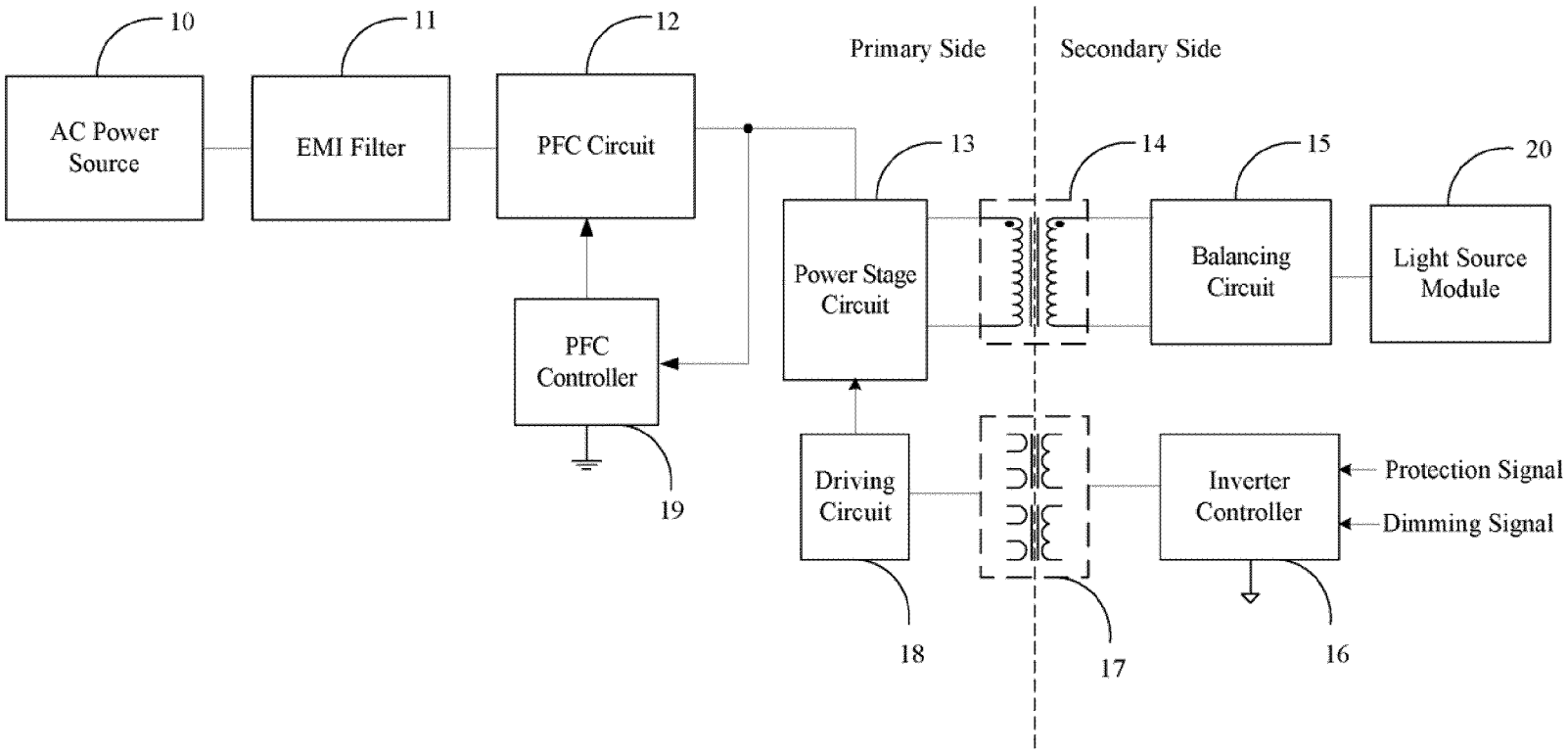
FIG. 6 (Related Art)
FIG. 6 is a block diagram of a commonly used light source driving device.

FIG. 5 is a block diagram of the light source driving device of a third embodiment, differing from that of FIG. 1 in that the light source driving device of FIG. 5 comprises a feedback comparison circuit 411 and a photo-coupler 413.

The feedback comparison circuit 411 is also disposed on the secondary side of the light source driving device, to receive the current feedback signal connected to the PFC controller 403 via the photo-coupler 413. The photo-coupler 413 isolates the feedback comparison circuit 411 from the PFC controller 403. The feedback comparison circuit 411 transmits the current feedback signal to the PFC controller 403 via the photo-coupler 413, and then the PFC controller 403 controls the PFC circuit 403 to adjust the output of the PFC circuit 403.

In the disclosure, an inverter controller circuit is divided into the inverter controller 414 and the inverter control signal processor 410 respectively disposed on the primary side and secondary side of the light source driving device, which only use one photo-coupler to replace the isolation transformer to transmit signals and the driving circuit 4144 is integrated into the inverter controller 414 at the same time. Therefore, driving circuit design is simplified and a small circuit board can be used due the absence of an isolation transformer.

Although the features and elements of the present disclosure are described in various inventive embodiments in particular combinations, each feature or element can be configured alone or in various within the principles of the present disclosure to the full extent indicated by the broad general meaning of the terms in which the appended claims are expressed.

What is claimed is:

1. A light source driving device for a light source module comprising a plurality of lamps, the light source driving device comprising:

a power factor correction (PFC) circuit to convert received alternating current (AC) signals into direct current (DC) signals;

a power stage circuit to convert the DC signals into square-wave signals;

a power conversion circuit comprising a transformer having a primary winding and a secondary winding, to convert the square-wave signals to electrical signals capable of driving the light source module, wherein the transformer divides the light source driving device into a primary side and a secondary side, and the primary winding of the transformer is disposed on the primary side of the light source driving device and the secondary winding of the transformer is disposed on the secondary side of the light source driving device;

a balancing circuit to balance current flowing through the plurality of lamps in the light source module;

an inverter control signal processor disposed on the secondary side of the light source driving device, to receive a first control signal output from the secondary side of the light source driving device and generate a second control signal according to the first control signal;

an inverter controller disposed on the primary side of the light source driving device and connected to the primary winding of the transformer, to drive the power stage circuit according to the second control signal output from the inverter control signal processor; and an isolation component connected between the inverter controller and the inverter control signal processor, to transmit the second control signal to the inverter controller and to isolate the inverter control signal processor from the inverter controllers;

wherein the first control signal comprises a dimming signal and a switch signal, wherein the inverter control signal processor comprises a dimming circuit and a switch circuit to receive and process the dimming signal and the switch signal and output a processed dimming signal and a processed switch signal respectively, wherein the dimming circuit and the switch circuit are connected to the isolation component via a logic circuit.

2. The light source driving device as claimed in claim 1, wherein the logic circuit comprises a AND gate and a switch circuit, and inputs of the AND gate is connected to the dimming circuit and the switch circuit, wherein the AND gate outputs the second control signal when receiving the processed dimming signal and the processed switch signal.

3. The light source driving device as claimed in claim 1, wherein the first control signal further comprises a protection signal.

4. The light source driving device as claimed in claim 3, wherein the inverter control signal processor comprises a protection circuit to receive and process the protection signal, and output the processed protection signal to the logic circuit.

5. The light source driving device as claimed in claim 4, wherein the logic circuit comprises an inverter, a AND gate and a switch, and an input of the inverter is connected to the protection circuit and inputs of the AND gate are connected to the inverter, the dimming circuit and the switch circuit, wherein the AND gate outputs the second control signal when receiving the processed dimming signal and the processed switch signal and not receiving the processed protection signal.

6. The light source driving device as claimed in claim 1, wherein the inverter controller comprises a driving circuit connected to the power stage circuit, and a switch and dimming controller connected to the isolation component, to receive the second control signal so as to control the driving circuit.

7. The light source driving device as claimed in claim 1, further comprising a feedback comparison circuit disposed on the secondary side of the light source driving device and connected to the inverter controller, to receive a current feedback signal and transmit to the inverter controller.

8. The light source driving device as claimed in claim 7, wherein the feedback comparison circuit comprises a three-terminal shunt regulator with an input pin to receive the current feedback signal and an output pin to output the current feedback signal.

9. The light source driving device as claimed in claim 8, wherein the inverter controller comprises a feedback circuit to receive the current feedback signal transmitted by the feedback comparison circuit.

10. The light source driving device as claimed in claim 9, further comprising a photo-coupler connected between the feedback comparison circuit and the inverter controller, to couple the current feedback signal to the feedback circuit and isolate the feedback comparison circuit from the inverter controller.

11. The light source driving device as claimed in claim 1, further comprising a power factor correction (PFC) controller connected to an output of the PFC circuit, to feed the output of the PFC circuit back to the PFC circuit to adjust the DC signals output from the PFC circuit.

12. The light source driving device as claimed in claim 11, further comprising a feedback comparison circuit disposed on the secondary side of the light source driving device and connected to the PFC controller, to receive the current feedback signal and transmit to the PFC controller.

13. The light source driving device as claimed in claim 12, wherein the feedback comparison circuit comprises a three-terminal shunt regulator with an input pin to receive the current feedback signal and an output pin to output the current feedback signal.

14. The light source driving device as claimed in claim 13, further comprising a photo-coupler connected between the feedback comparison circuit and the PFC controller, to transmit the current feedback signal to the feedback circuit and isolate the feedback comparison circuit from the PFC controller.

* * * * *